United States Patent [19]

Foster

[11] Patent Number: 4,473,980

[45] Date of Patent: Oct. 2, 1984

[54] THERMAL INSULATION STRUCTURE FOR WINDOWS

[75] Inventor: Kenneth J. Foster, Dedham, Mass.

[73] Assignee: Econ Incorporated, Boston, Mass.

[21] Appl. No.: 217,427

[22] Filed: Dec. 17, 1980

Related U.S. Application Data

[63] Continuation of Ser. No. 940,715, Sep. 8, 1978.

[51] Int. Cl.[3] ..... E06B 3/26

[52] U.S. Cl. ..... 52/202; 52/DIG. 4; 49/62

[58] Field of Search ..... 52/202, 203, DIG. 4; 49/478, 62; 40/600

[56] References Cited

U.S. PATENT DOCUMENTS

| | | | |
|---|---|---|---|
| 1,694,676 | 12/1928 | Will . | |
| 2,219,699 | 10/1940 | Owen | 20/56.5 |
| 2,595,833 | 5/1952 | Flaherty | 160/369 |
| 2,855,242 | 10/1958 | Holmes | 296/97 |
| 2,943,246 | 6/1960 | Riordan | 317/159 |
| 2,959,832 | 11/1960 | Baermann | 24/201 |
| 3,016,952 | 1/1962 | Shero | 160/354 |
| 3,133,324 | 5/1964 | Foreman | 20/52 |
| 3,350,045 | 10/1967 | Mayers | 52/DIG. 4 X |
| 3,797,151 | 3/1974 | Dexter | 40/129 |
| 4,069,641 | 1/1978 | DeZutter | 52/202 |
| 4,079,558 | 3/1978 | Gorham | 52/202 |
| 4,182,088 | 1/1980 | Ball | 52/202 |
| 4,194,331 | 3/1980 | Gingle et al. | 52/203 |
| 4,272,942 | 6/1981 | Jackson | 52/202 X |
| 4,387,541 | 6/1983 | Boomershire | 52/202 |
| 4,407,099 | 10/1983 | McLaughlin | 52/202 |

FOREIGN PATENT DOCUMENTS

| | | | |
|---|---|---|---|
| 273691 | 11/1964 | Australia . | |
| 707857 | 4/1965 | Canada . | |
| 1043272 | 9/1966 | United Kingdom | 52/DIG. 4 |
| 1274118 | 5/1972 | United Kingdom | 52/202 |

*Primary Examiner*—Carl D. Friedman

*Attorney, Agent, or Firm*—Paul J. Cook

[57] ABSTRACT

A thermal insulation structure for windows including a flat, transparent or translucent plastic sheet and a frame structure adapted to clamp the edges of the sheet and adapted to be magnetically attached to an existing ferromagnetic window frame or to a ferromagnetic or magnetic strip adhered to a window, window frame or opening. The frame structure comprises a U-shaped member and a magnetic strip secured to one prong of the U-shaped member or a L-shaped member secured to one surface of the sheet while the magnetic strip is adhered to the opposing surface of the sheet. The insulation structure is transparent to outside light and provides a simple means for significantly reducing conducted and radiated heat loss through the window and for eliminating window air infiltration heat loss.

17 Claims, 2 Drawing Figures

THERMAL INSULATION STRUCTURE FOR WINDOWS

This is a continuation of application Ser. No. 940,715 filed Sept. 8, 1978.

BACKGROUND OF THE INVENTION

This invention relates to a composite structure adapted to provide thermal insulation for windows.

Window heat loss accounts for about 20–40% of building space heating costs. With continuing increases in fuel costs, existing structures require an inexpensive and practical means for converting single pane glass windows to thermal insulators. Presently employed means include double-pane windows constructed to form a sealed air space between the panes. Alternatively, an equivalent second (storm) window is added to function in conjunction with the window to form an insulating air space. The present insulating means are undesirable since they are expensive to make and to install. Furthermore, even though these double-pane arrangements reduce heat loss due to conduction through the outside glass pane, there is still substantial heat loss caused by convection of the air within the air space which promotes conduction heat loss through the outside pane. Additionally, conventional storm windows reduce cold air infiltration, a major heat loss component, by only $\frac{1}{3}$ to $\frac{1}{2}$.

It would be desirable to provide a means for thermally insulating glass windows with little or no structural modification. Furthermore, it would be desirable to provide a glass thermal insulation means which requires little or no labor costs and which can be produced without the need for special installation tools. In addition, it would be desirable to provide a thermal insulation means for glass windows which can be modified easily to change its light transmission or reflectance characteristics thereby to permit its preferential use at different exposures of a building. Furthermore, it would be desirable to provide such a thermal insulation means which minimizes convection heat loss and eliminates air infiltration heat loss which can be equal to or greater than the conducted heat loss. It is also desirable to provide a thermal insulation that can be installed independent of weather characteristics and whose installation cost is not dependent on building height (because of the difficulty of access) as is the situation with presently employed means. Additionally, it would be advantageous to provide a window thermal insulation that can be removed and installed, literally in seconds, for cleaning or ventilation purposes and, if provided in two pieces, the lower half of which can be removed and magnetically self-stored over the top half when it is desired to open the window for ventilation or for summer storage. Additionally, it would be advantageous to provide a window thermal insulation that can be removed easily to change the summer/winter solar energy transmission characteristics to maximize total energy savings and/or comfort and to facilitate cleaning or repair of the window insulation or prime window.

SUMMARY OF THE INVENTION

This invention provides a window insulation means which provides effective thermal insulation without drastically changing the light transmission function of the window. The insulation means comprises a transparent, flat, flexible sheet and a frame means for retaining the sheet. The frame means comprises a U-shaped member having a slot into which the edges of the flat sheet can be fit or an L-shaped member which fits on the edge of the sheet. A strip of magnetic material is secured to the outside surface of one of the prongs of the U-shaped member or directly to the sheet. The frame structure is attached to the window on the window face by securing a strip of magnetizable material thereto or by contacting the frame structure directly to a window frame which is made of a magnetizable material. The resultant insulated window, when in place in a building structure, then permits light to enter the building interior while providing effective thermal insulation and eliminating air leakage between the inside and out side environments.

DETAILED DESCRIPTION OF PREFERRED EMBODIMENTS

Figure 1:
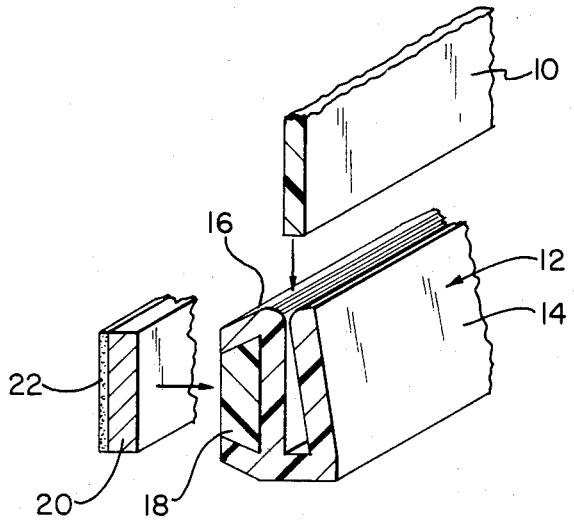
FIG. 1 is a perspective view of the U-shaped frame structure used in this invention.

The thermal insulation structure of this invention creates a trapped dead air space on the inside surface of a window thereby providing effective thermal insulation between the outdoor and indoor environments. The space has a depth between about $\frac{1}{4}$ inch and 4 inches, preferably between about $\frac{1}{2}$ inch and 2 inches. It has been found that when the depth of the space exceeds about 4 inches, air convection within the space increases thermal conduction through the window. When the depth of the air space is less than about $\frac{1}{4}$ inch, there is substantial heat loss due to conduction through the window.

Numerous materials known as plastics can be utilized for forming the transparent, flat sheet. These include polymethyl methacrylate, polyethylene terephthalate, acrylonitrile-vinylidene chloride copolymers, polyvinyl chloride, polyvinylidene chloride, polyethylene, polycarbonates, styrenes, acrylics and fluorocarbon polymers or the like. The plastic compositions can contain the usual resin additives such as ultraviolet light stabilizers, smoke or flame retardants, plasticizers or the like. In addition, the plastic compositions can contain a colorant or filler composition or the like or have a surface treatment to render the sheet translucent, partially opaque to selected wavelengths of light for the light or heat control, privacy, aesthetic reasons or to increase strength. In one aspect of this invention, the plastic compositions include additives which permit control of the light transmission characteristics of the plastic compositions. In another aspect, infrared absorbent compositions such as those used to produce solar bronze and solar gray glass and plastics and the like can be added to the plastic compositions forming the flat sheet. The infrared absorber composition absorbs infrared radiation from the sun and reradiates the absorbed energy isotropically in longer wavelengths so that the infrared absorber acts to reduce and redistribute the infrared radiation transmission from the sun to the interior of the building. In this mode, the insulating means of this invention is used when it is desired to maintain the interior of the building cool. Microlouvers can be incorporated in the flat sheet to reject solar energy in the summer, and upon reversal of the flat sheet, to admit solar energy in the winter. That is, small strips of absorbent or reflective material can be molded into the sheet during sheet formation and positioned at any desired angle relative to the sheet surface. Alternatively, the flat sheet can be coated with a thin metallized layer such as aluminum or silver in the order of about 200 Angstroms thick so that a portion of the visible light can be transmitted through the insulation structure while reflecting a portion of the visible and the infrared radiation from the sun. In addition, the flat sheet can be tinted to reduce the total amount of radiation transmitted thereby to achieve substantially the same effect. The infrared radiation generated by normal room heat has a wavelength of about 3 to 150 microns, which is a longer wavelength than the sun's infrared radiation. It is desirable to prevent this long wavelength infrared from reaching the window glass in order to conserve room heat. This may be accomplished by additives to the plastic composition which are substantially transparent to visible light and substantially absorbent or opaque to the long wavelength room heat infrared radiation. Suitable additives for this purpose include the transparent or translucent metallic fluorides such as $AlF_3.3NaF$, $CaF_2$, $MgF_4$, $NaSiF_6$ and the like as well as other long wavelength infrared absorbers known in the art. Alternatively, the flat sheet can be coated with a material(s) which reflects the room heat back into the room while selectively transmitting solar visible and solar infrared radiation. Representative suitable coating compositions for this purpose include thin metallic coatings, multilayer thin dielectric or dielectric/ metal coatings, doped semiconductor coatings, thin film metallic or semiconductor girds or the like applied directly to the flat sheet or to a film which is applied to the flat sheet. Thus, as is evident from the above, the insulation structure of this invention can be modified with compositions or coatings having the appropriate light absorbence or reflectance characteristics to regulate the frequency of radiation entering or retained within a room.

Referring to FIG. 1, the insulating structure includes a flat thermoplastic sheet 10 and a U-shaped frame 12. The U-shaped frame can be formed of any metal, e.g. roll formed or extruded or a plastic material or the like. The window insulation frame 12 has two prongs 14 and 16. Prong 16 has a relatively thick wall into which is fit a magnetic strip 18 which is normally mechanically self-locked into place by means of its shape in conjunction with the shape of prong 16 or otherwise secured such as with an adhesive. Suitable magnetic strip material includes thermoplastic, elastomeric, resinous or otherwise flexible compositions having a magnetic filler material diposed therein such as barium ferrite or the like. The prong 14 is formed so that it is sprung toward the prong 16 and when the sheet 10 is inserted between the prongs, it is held tightly thereby. When the window insulation frame structure is positioned on a window or window frame, the magnetic strip 18 cooperates with an auxiliary ferromagnetic or magnetic strip 20 having an adhesive layer 22, or alternatively, a mechanical means by which it is adhered to a window or window frame. The strip 20 is not needed when the window frame itself is formed of a ferromagnetic material. Alternatively, the position of the strip 20 and the magnetic strip 18 can be reversed if desired. Strip 20 can also be a magnetic strip used in conjunction with the window insulation magentic strip 18 to increase the magnetic attraction force for greater holding power. Strip 20 can be secured by any means such as adhesively or mechanically. The thickness of the prong 16 can regulate the depth of the air space between the window (not shown) and the sheet 10 as desired. In one aspect, the strip 20 can comprise a ferromagnetic or magnetic layer, and an adhesive layer with a foam layer interposed between the ferromagnetic layer and the adhesive layer. Such a structure permits a relatively flat surface of ferromagnetic or magnetic material even when the frame surface is irregular. In another aspect of this structure, a thin strip of ferromagnetic material, e.g. 0.001–0.032 inch thick steel can be inserted between the prong 16 and magnetic strip 18. This additional strip improves the mechanical stability of the frame structure and orients the magnetic lines of force in the strip 18 thereby to improve magnetic attraction between magnetic strip 18 and ferromagnetic strip 20 or a ferromagnetic window frame.

The adhesive composition 22 must provide sufficient long-life tack to retain the structure in place on the window. The adhesive composition should be capable of retaining its adhesive characteristics over a wide temperature range, e.g. from about −40° F. to about 160° F. In addition, the adhesive composition should be capable of withstanding extreme exposure to the sun's radiation including the effects of visible, infrared and ultraviolet light and of moisture which may be present from condensation on the inside surface of a window. In addition, the adhesive should provide shear stability under the constant shear forces exerted by the force of gravity. Representative suitable adhesives are based upon silicone resins, butyl resins, acrylic resins, hot melts or the like. For purposes of the present invention, a long chain, high molecular weight, elastomeric, aliphatic serves the purpose best. A particularly suitable adhesive has the following formulation:

| Components | Content by Weight |
|---|---|
| 2 ethyl hexyl acrylate | 30 |
| dioctyl maleate | 30 |
| vinyl acetate | 20 |
| ethyl acrylate | 20 |
| Na salt of the sulfate of t-octyl phenoxy ethoxy ethanol | 3.8 |
| ammonium persulfate | 0.165 |
| methacrylic acid | 0.75 |
| diallyl maleate | 0.07 |
| water | 102 |

This adhesive is produced by the process of emulsion polymerization at a temperature of 80° C. for a reaction time of about 4 hours. After the reaction is complete, conversion is 99.8%, the adhesive is in the form of a fine particle dispersion, particle size ranges from about 0.2 to 0.8 microns, averaging 0.4 microns. This adhesive is chemically referred to as a modified acrylic tetramer. The average molecular weight of the adhesive is about 80,000. The adhesive is very elastomeric, posesses excellent specific tack to nonpolar plastics; is very water resistant and possesses extreme stability to radiation. The adhesive also maintains an aggressive tack over a broad temperature range of about −40° F. to about 366° F. This adhesive is applied by conventional coating techniques to the insulation structure of this invention. The method of application, the configuration of deposit and the amount of deposition are all variables that can be controlled for optimum end-use performance. Thus, for example, the adhesive can be layered or intermittently applied to the strip 20. It is preferred that the adhesive composition stick preferentially to the ferromagnetic strip so that it can be removed easily if desired.

Figure 2:
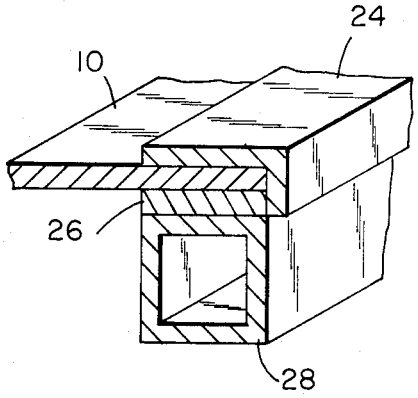
FIG. 2 is a perspective view of the L-shaped frame structure used in this invention.

Referring to FIG. 2, the insulating structure includes a flat transparent or translucent sheet 10 and a ferromagnetic L-shaped frame 24 adhered to the sheet 10. A magnetic strip 26 is adhered to the surface of the sheet 10 opposite the surface to which the L-shaped frame 24 is adhered. The strip 26 is magnetically secured to a ferromagnetic window frame 28 or to a separate ferromagnetic or magnetic strip as depicted by 20 of FIG. 1. This embodiment can be stored easily when not in use by magnetically securing strip 26 to an L-shaped member of a different insulation structure such as may be stored on the upper portion of a window.

The structure of this invention provides substantial advantages over prior art proposals for thermally insulating windows. The magnetic thermal insulation can be directly and easily hand applied to steel frame (ferromagnetic) windows with no additional installation steps. It then magnetically attaches itself and seals to the ferromagnetic window frame. Additionally, the thermal insulation can be conveniently hand applied to windows which do not have ferromagnetic frames by removing a conventional release medium, if utilized, such as a silicone coated paper or plastic film from the adhesive and laying the ferromagnetic strip on the window frame or window with the adhesive in contact with the frame or window. The window insulation is then simply positioned in place against the ferromagnetic strip to which it magnetically attaches and seals. Furthermore, this invention eliminates expansion/ contraction problems between the insulating structure and the prime window in that the insulation structure is free to grow or shrink in accordance with temperature changes by merely magnetically sliding along the window frame. This permits insulating very large windows with a single plastic sheet that cannot be done with a plastic glazing because of large temperature coefficients of expansion. In addition, the insulation structure can be removed or installed manually in seconds when desired. Since the installation is effected inside, outside architectural aesthetics can be maintained. Also, the thermal insulation is positioned from the inside without the installation process or the materials themselves being adversely affected by the weather. Installation costs do not increase with building height as they do with conventional insulating window installations. In addition, the thermal insulation is self-supporting and sealing and does not require additional supporting means. Obviously, this invention requires less labor and cost than is necessary for forming conventional double-pane, sealed windows or for positioning storm windows. Furthermore, the thermal insulation of this invention can be positioned on only parts of the window so that, for example, it can be placed on the top portion of the window where heat losses are greater while permitting a complete view through the bottom portion of the window corresponding to normal eye level. In addition, the thermal insulation, once positioned, does not interfere with the normal operation of the window, so that it can be raised, lowered or swung as was possible in its unmodified state, merely by manually removing the magnetically attached thermal insulation from the steel window frame or from the ferromagnetic strip adhered on to the window frame. If the magnetic thermal window insulation is provided in two halves, the lower half can be simply stored magnetically over the top half when it is desired to open the window for ventilation or for summer storage purposes. In addition, since the thermal insulation is a low mass structure, it imposes no significant mechanical stress on the glass or window frame.

An additional feature of the magnetic thermal insulation is that it forms a complete seal around the perimeter of the window and essentially eliminates cold air leakage (infiltration). In this respect, the magnetic thermal insulation system is 25% to 50% more efficient than conventional storm windows in reducing heat loss through the window.

What is claimed is:

1. An insulation structure capable of being attached to a window frame enclosing a primary window which comprises:

a flat transparent or translucent sheet having an edge, a frame means comprising a U-shaped member of unitary construction having two prongs, said prongs adapted to enclose the edge of said sheet, a first strip having a first flat planar surface along its length selected from the group consisting of a flexible magnetic strip and a ferromagnetic strip, and a second strip having a second flat planar surface along its length selected from the group consisting of a flexible magnetic strip and a ferromagnetic strip, at least one of said first strip or said second strip being a flexible magnetic strip, said first strip being rigidly secured directly to or comprising one of said prongs, said second strip being secured to said window frame, said first strip and said second strip being positioned to directly contact each other with said first planar flat surface and said second planar flat surface contacting each other in face to face relation thereby to position said sheet between about $\frac{1}{4}$ inch and 4 inches from said primary window and to form a continuous air-tight seal between said first strip and said second strip.

2. The structure of claim 1 wherein said first strip is a flexible magnetic strip and is secured directly to one of said prongs.

3. The structure of claim 1 wherein said first strip is a ferromagnetic strip and is secured directly to one of said prongs.

4. The structure of claim 1 wherein said ferromagnetic strip comprises one of said prongs.

5. The structure of claim 1 wherein said first strip is a flexible magnetic strip formed from a ferromagnetic or ferrimagnetic powder loaded elastomeric material.

6. The structure of claim 1 wherein said second strip includes a foam layer interposed between an adhesive layer and said ferromagnetic strip or flexible magnetic strip, said adhesive adapted to secure said second strip to said window frame.

7. The structure of claim 1 wherein said first strip is a flexible magnetic strip secured directly to one of said prongs and a third strip of a ferromagnetic metal is interposed between said first strip and said one of said prongs to substantially increase the magnetic attraction of said first strip.

8. The structure of any one of claims 1, 2, 3, 4, 5, 6 or 7 wherein said each of said first strip and said second strip comprises a flexible magnetic strip.

9. The insulation structure of any one of claims 1, 2, 3, 4, 5, 6 or 7 wherein one of said first strip or said second strip comprises a ferromagnetic strip.

10. A frame means suitable for enclosing the edge of a flat transparent or translucent sheet in order to substantially precent air-filtration about the periphery of said sheet by utilizing direct contact magnetic gasket sealing and to magnetically secure said sheet adjacent an installed window by means of direct contact magnetic attachment, said frame means comprising a U-shaped member of unitary structure having two prongs, said prongs adapted to enclose the edge of said flat transparent or translucent sheet, and a first strip having a first flat planar surface along its length selected from the group consisting of a flexible magnetic strip and a ferromagnetic strip, said first strip being rigidly secured directly to one of said prong and being positioned to coact by magnetic attraction with a second strip selected from the group consisting of a magnetic strip and a ferromagnetic member positioned on a window frame for said window adjacent said window to form a continuous airtight seal between said first strip and said second strip.

11. The structure of claim 10 wherein said first strip is a flexible magnetic strip.

12. The structure of claim 10 wherein said first strip is a ferromagnetic strip.

13. The structure of claim 10 wherein said first strip is a magnetic strip formed from a ferromagnetic or a ferrimagnetic powder-loaded elastomeric material.

14. An insulation structure capable of being attached to a window frame enclosing a primary window which comprises:

a flat transparent or translucent sheet, having an edge, a frame means comprising a U-shaped member of unitary construction having two prongs, said prongs adapted to enclose the edge of said sheet, a first strip having a first flat planar surface along its length comprising a flexible magnetic strip being rigidly mechanically locked directly within a channel on one of said prongs, and a second strip having a second flat planar surface along its length comprising a ferromagnetic strip being secured to said window frame, said first strip and said second strip being positioned to directly contact each other with said first planar flat surface and said second planar flat surface contacting each other in face to face relationship thereby to position said sheet between about ¼ inch and 4 inches from said primary window and to form a continuous air-tight seal between said first strip and said second strip.

15. The structure of claim 14 wherein in second strip a foam layer is interposed between an adhesive layer and said ferromagnetic strip, said adhesive layer adapted to secure said second strip to said window frame.

16. The structure of any one of claims 14 and 15 wherein a third strip of ferromagnetic metal is interposed between said first strip and said one of said prongs.

17. The structure of any one of claims 14 and 15 wherein said continuous air-tight seal is accomplished about substantially the entire perimeter of said frame means.

* * * * *

US004473980B1

REEXAMINATION CERTIFICATE (1858th)

United States Patent [19]

Foster

[11] B1 4,473,980

[45] Certificate Issued Dec. 1, 1992

[54] THERMAL INSULATION STRUCTURE FOR WINDOWS

[75] Inventor: Kenneth J. Foster, Dedham, Mass.

[73] Assignee: Econ Incorporated, Boston, Mass.

Reexamination Request:
No. 90/002,297, Mar. 15, 1991

Reexamination Certificate for:

| | |
|---|---|
| Patent No.: | **4,473,980** |
| Issued: | **Oct. 2, 1984** |
| Appl. No.: | **217,427** |
| Filed: | **Dec. 17, 1980** |

Related U.S. Application Data

[63] Continuation of Ser. No. 940,715, Sep. 8, 1978, abandoned.

[51] Int. Cl.[5] ..... E06B 3/26

[52] U.S. Cl. ..... 52/202; 52/DIG. 4; 49/62

[56] References Cited

U.S. PATENT DOCUMENTS 4,079,558 3/1978 Gorham .

FOREIGN PATENT DOCUMENTS 2294310 9/1976 France .
6405781 12/1964 Netherlands .
7512066 4/1977 Netherlands .

*Primary Examiner*—David A. Scherbel

[57] ABSTRACT

A thermal insulation structure for windows including a flat, transparent or translucent plastic sheet and a frame structure adapted to clamp the edges of the sheet and adapted to be magnetically attached to an existing ferromagnetic window frame or to a ferromagnetic or magnetic strip adhered to a window, window frame or opening. The frame structure comprises a U-shaped member and a magnetic strip secured to one prong of the U-shaped member or a L-shaped member secured to one surface of the sheet while the magnetic strip is adhered to the opposing surface of the sheet. The insulation structure is transparent to outside light and provides a simple means for significantly reducing conducted and radiated heat loss through the window and for eliminating window air infiltration heat loss.

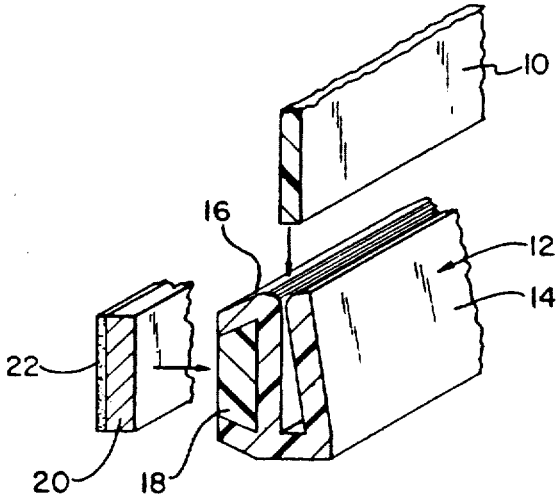

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 10 and 14 are determined to be patentable as amended.

Claims 2-9, 11-13 and 15-17, dependent on an amended claim, are determined to be patentable.

1. An insulation structure capable of being attached to a window frame enclosing a primary window which comprises:

a flat transparent or translucent sheet having an edge, a frame means comprising a U-shaped member of unitary construction having two prongs, said prongs adapted to enclose the edge of said sheet, a first strip having a first flat planar surface along its length selected from the group consisting of a flexible magnetic strip and a ferromagnetic strip, and a second strip having a second flat planar surface along its length selected from the group consisting of a flexible magnetic strip and a ferromagnetic strip, at least one of said first strip or said second strip being a flexible magnetic strip, said first strip being rigidly secured directly to or comprising one of said prongs, said second strip being *rigidly* secured to said window frame, said first strip and said second strip being positioned to directly contact each other with said first planar flat surface and second planar flat surface contacting each other in face to face relation thereby to position said sheet between about ¼ inch and 4 inches from said primary window and to form a continuous air-tight seal between said first strip and said second strip.

10. A frame means suitable for enclosing the edge of a flat transparent or translucent sheet in order to substantially [precent] *prevent* air-filtration about the periphery of said sheet by utilizing direct contact magnetic gasket sealing and to magnetically secure said sheet adjacent an installed window by means of direct contact magnetic attachment, said frame means comprising a U-shaped member of unitary structure having two prongs, said prongs adapted to enclose the edge of said flat transparent or translucent sheet, and a first strip having a first flat planar surface along its length selected from the group consisting of a flexible magnetic strip and a ferromagnetic strip, said first strip being rigidly secured directly to one of said [prong] *prongs* and being positioned to coact by magnetic attraction with a second strip selected from the group consisting of a magnetic strip and a ferromagnetic member *rigidly* positioned on a window frame for said window adjacent said window to form a continuous airtight seal between said first strip and said second strip.

14. An insulation structure capable of being attached to a window frame enclosing a primary window which comprises:

a flat transparent or translucent sheet, having an edge, a frame means comprising a U-shaped member of unitary construction having two prongs, said prongs adapted to enclose the edge of said sheet, a first strip having a first flat planar surface along its length comprising a flexible magnetic strip being rigidly mechanically locked directly within a channel on one of said prongs, and a second strip having a second flat planar surface along its length comprising a ferromagnetic strip being *rigidly* secured to said window frame, said first strip and said second strip being positioned to directly contact each other with said first planar flat surface and said second planar flat surface contacting each other in face to face relationship thereby to position said sheet between about ¼ inch and 4 inches from said primary window and to form a continuous air-tight seal between said first strip and said second strip.

* * * * *